US005899471A

United States Patent [19]

Li-Wei

[11] Patent Number: 5,899,471

[45] Date of Patent: May 4, 1999

[54] WALKER FOR BABY

[76] Inventor: Lu Li-Wei, No. 59-16, Chiu She Lane, Chiu She Li, Pei Tun Dist., Taichung City, Taiwan

[21] Appl. No.: 09/089,953

[22] Filed: Jun. 3, 1998

[51] Int. Cl.[6] ..... B62B 7/00

[52] U.S. Cl. ..... 280/87.051; 280/650; 280/647; 188/5

[58] Field of Search ..... 280/650, 87.051, 280/647, 657, 658; 188/5, 6, 7, 87.042, 5.32

[56] References Cited

U.S. PATENT DOCUMENTS

| | | | |
|---|---|---|---|
| 4,699,392 | 10/1987 | Ku | 280/87.051 |
| 4,776,415 | 10/1988 | Brice | 280/87.051 |
| 5,203,581 | 4/1993 | Jankowski | 280/87.051 |
| 5,462,300 | 10/1995 | Chien | 280/87.051 |
| 5,727,800 | 3/1998 | Liu | 280/87.051 |
| 5,732,961 | 3/1998 | Theodoropoulos | 280/87.051 |
| 5,813,681 | 9/1998 | Saint et al. | 280/87.051 |

*Primary Examiner*—Lanna Mai
*Assistant Examiner*—Andrew J. Fischer
*Attorney, Agent, or Firm*—Harrison & Egbert

[57] ABSTRACT

A walker is intended for use by a baby who is learning to walk. The walker has a base which is provided in the underside thereof with a plurality of skidproof structures. The bottom of each skidproof structure has a reference plane slightly higher than a wheel set which is fastened with the base and is composed of a universal wheel and a wheel seat assembly. The wheel seat assembly includes a one-way roller and a threaded rod for confining and locating the one-way roller such that the moving range of the walker can be controlled to ensure the baby against accidents.

3 Claims, 7 Drawing Sheets

WALKER FOR BABY

FIELD OF THE INVENTION

The present invention relates generally to a walker, and more particularly to a walker for use by a baby who is learning to walk.

BACKGROUND OF THE INVENTION

As shown in FIG. 1, a prior art walker is intended for use by babies who are learning to walk and is composed of a base 10 provided thereunder with a plurality of wheels 11 fastened pivotally therewith. Such a prior art walker as described above is defective in design in that it is devoid of a safety feature, and is therefore vulnerable to an accident, as shown in FIG. 2.

SUMMARY OF THE INVENTION

The primary objective of the present invention is therefore to provide an improved walker comprising a base which is provided in the underside thereof with a plurality of skid-proof structures. The bottom of each of the skidproof structures has a reference plane slightly higher than a wheel set which is fastened to the base and is composed of a universal wheel and a wheel seat assembly. The wheel seat assembly comprises a one-way roller and a threaded rod for confining and locating the one-way roller such that the moving range of the walker can be controlled to ensure against accidents.

DETAILED DESCRIPTION OF THE INVENTION

Figure 1:
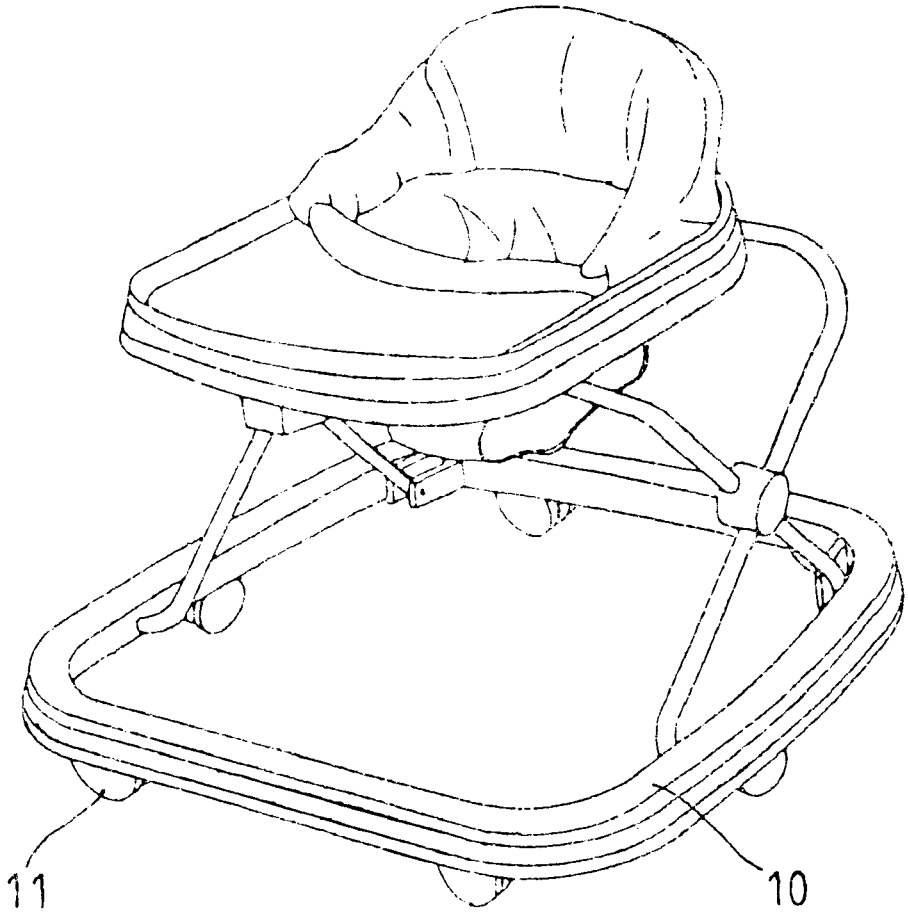
FIG. 1 PRIOR ART
FIG. 1 shows a perspective view of the prior art walker.
Figure 2:
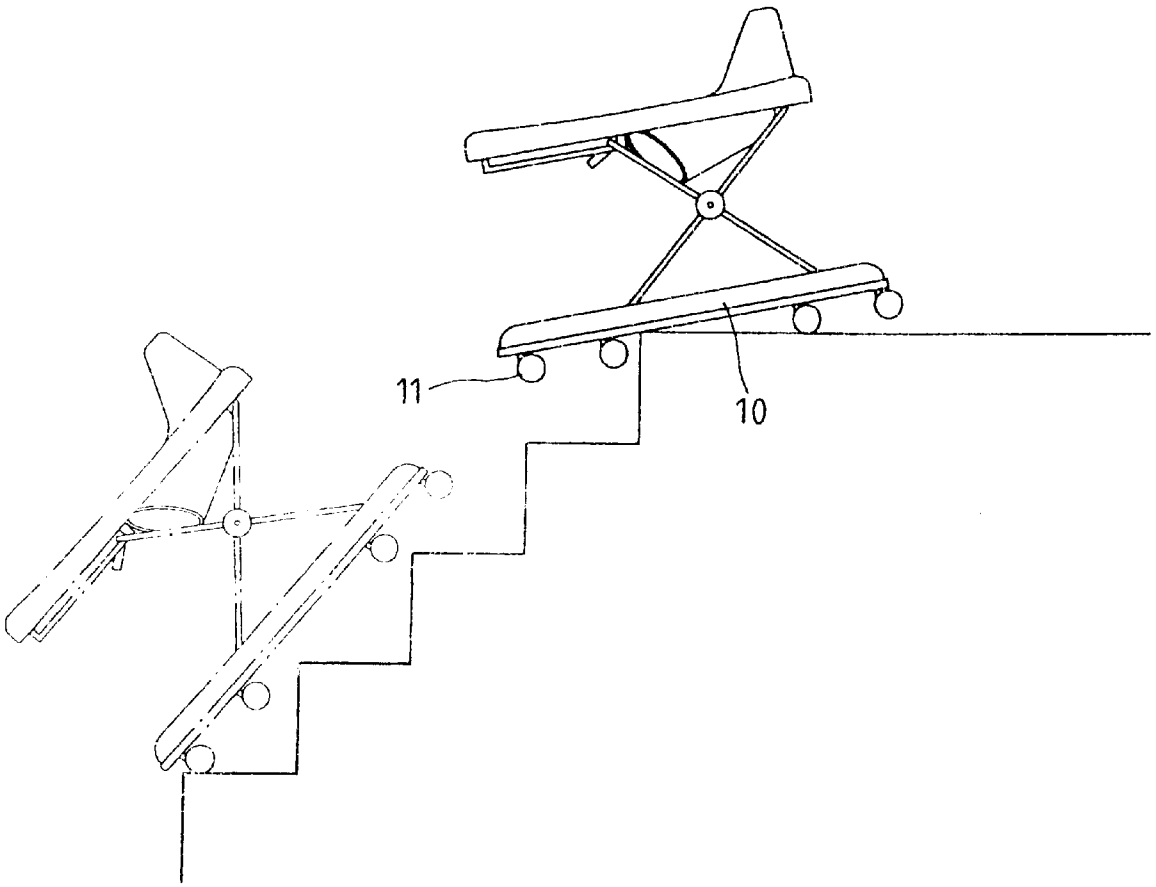
FIG. 2 PRIOR ART
FIG. 2 shows a schematic view of the prior art walker involved in an accident.
Figure 3:
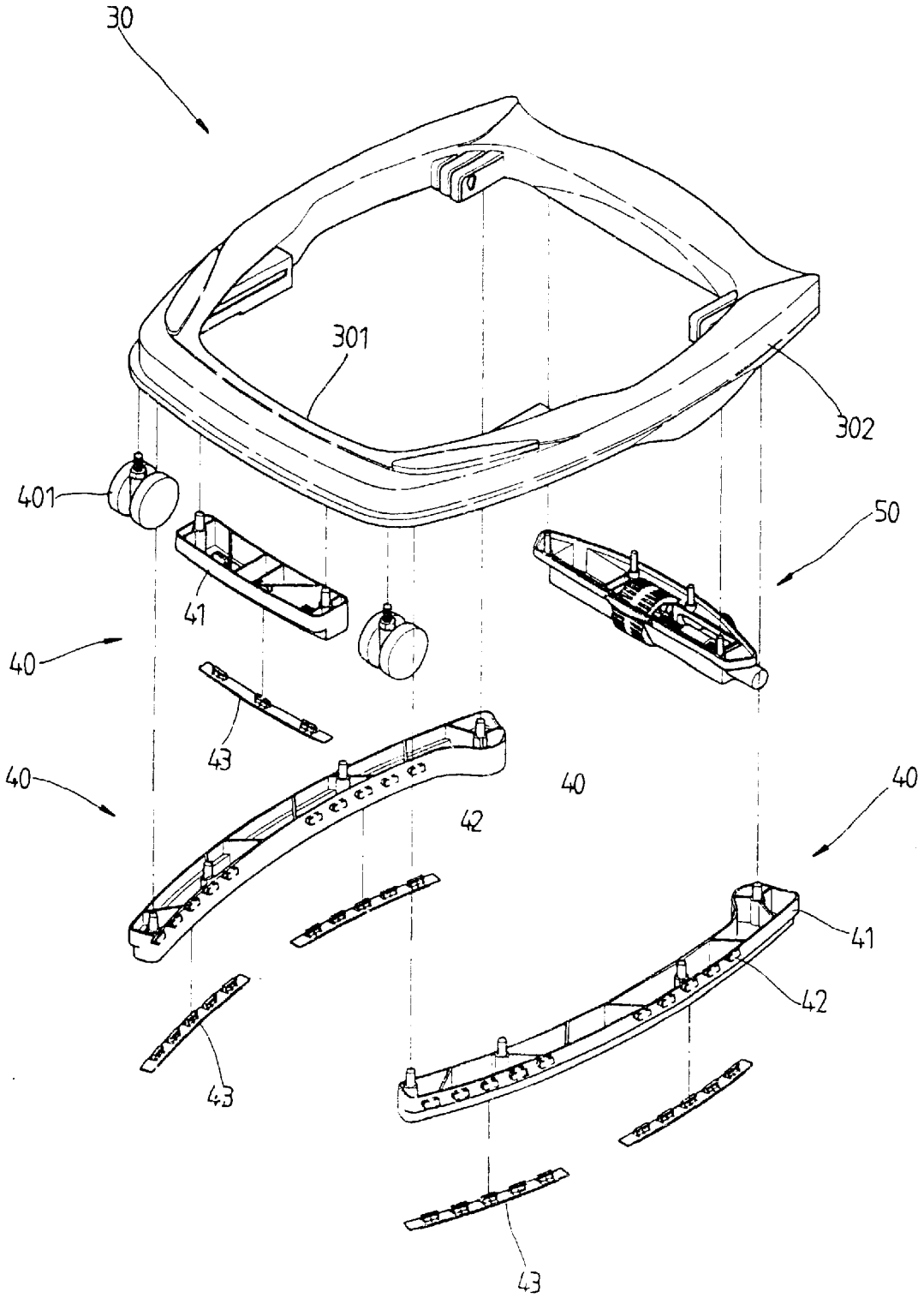
FIG. 3 shows a partial exploded view of the present invention.
Figure 4:
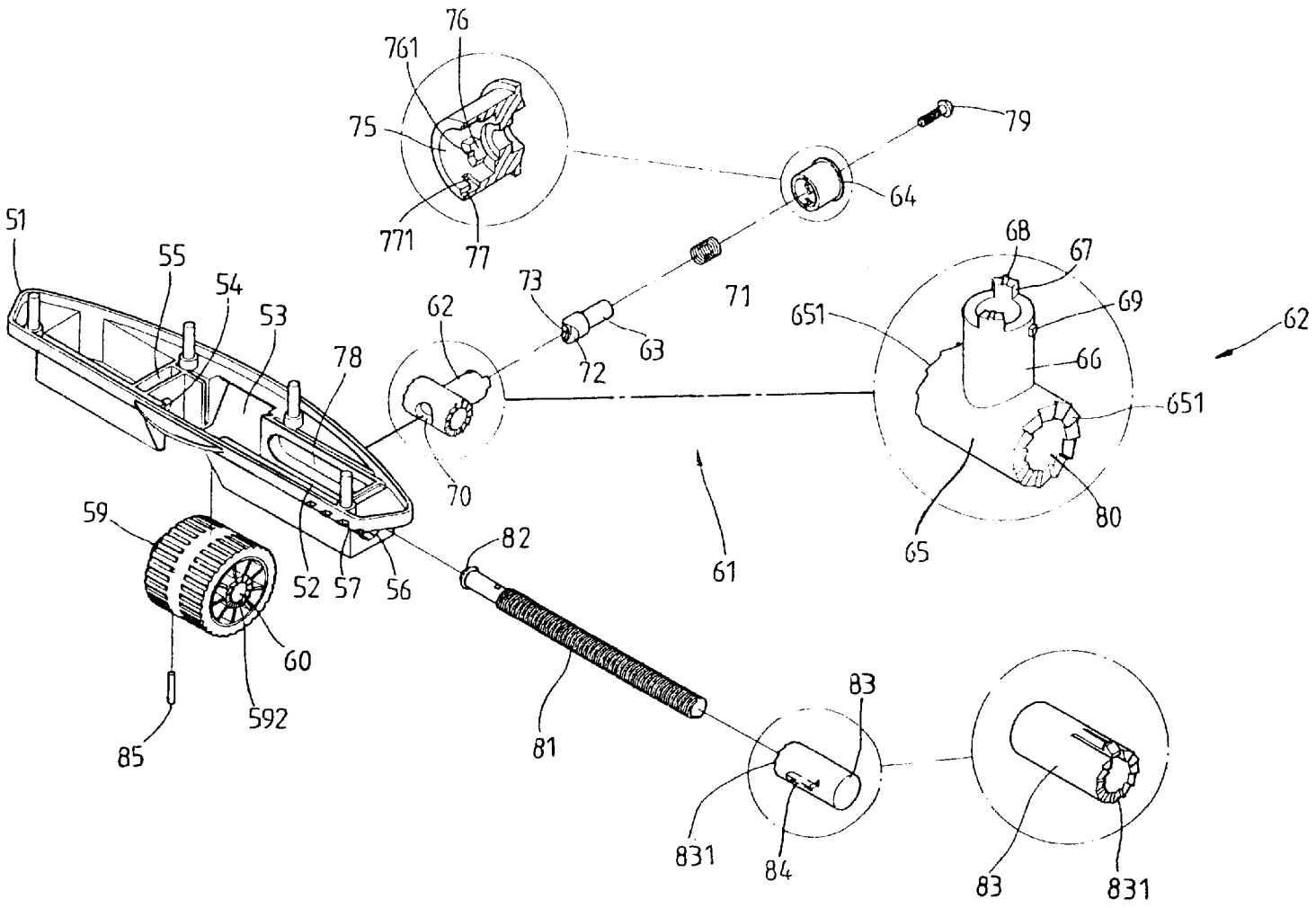
FIG. 4 shows an exploded view of the wheel seat assembly of the present invention.

As shown in FIGS. 3 and 4, a walker embodied in the present invention is composed of a base 30, which is provided respectively in the undersides of a front side 301 thereof and two lateral sides 302 thereof with a skidproof structure 40 such that the reference plane of the bottom of the skidproof structure 40 is slightly higher than a wheel set which is fastened to the base 30. The wheel set comprises a universal wheel 401 located at the front side 301, and a one-way wheel seat assembly 50 located at the rear side 303 of the base 30.

The wheel seat assembly 50 comprises a seat body 51, a locating member 61, a threaded rod 81, and a position controlling sleeve 83.

The seat body 51 is fastened in the underside of the rear side 303 of the base 30 by a plurality of bolts and is provided at the top thereof with a receiving slot 52. The seat body 51 is further provided with a wheel hole 53 extending throughout the bottom of the seat body 51, a stop wall 55 having a cross through hole 54 and contiguous to the wheel hole 53, and an insertion hole 56 opposite in location to the cross through hole 54. Located between the wheel hole 53 and the insertion hole 56 are a plurality of retaining holes 57. The one-way roller 58 is disposed in the wheel hole 53 such that the locating projection 59 of the roller 58 is in contact with the stop wall 55 of the seat body 51, and that the cross axial hole 60 of the one-way roller 58 is in communication with the cross through hole 54 of the stop wall 55.

The locating member 61 is made up of a position confining member 62, a retaining member 63, and a position controlling button 64. The position confining member 62 is of a hollow construction and is provided in one side thereof with a cross tube 65 coaxial with the receiving slot 52 and having a straight tube 66. The straight tube 66 is provided with two protruded pieces 67, a small protuberance 68, and two protruded edges 69. The two protruded pieces 67 and two protruded edges 69 are arranged in a cruciform manner. The position confining member 62 is engaged with the retaining member 63 such that one end of the position confining member 62 is fitted into a spring 71 and the straight tube 66, and that the arcuate edge 72 of another end of the position confining member 62 is engaged with the retaining piece 73, and further that the straight tube 66 is located in a hole 75 having two stop edges 76 opposite to each other and having a recessed edge 761. The position control button 64 are provided with two slots 77 opposite to each other. The cross tube 65 of the position confining member 62 is received in the receiving slot 52 of the seat body 51 such that the straight tube 66 is engaged with the position control button 64. The position control button 64 is fastened with the retaining member 63 by a fastening bolt 79 such that the position control button 64 is capable of actuating the retaining member 63 to displace in the direction toward the straight tube 66. The retaining member 63 is caused to return to its original position by the elastic force of the spring 71. The cross tube 65 has two through holes 80 which are opposite in location to the cross axial hole 60 of the one-way roller 58 and the insertion hole 56 of the seat body 51.

The threaded hole 81 has a sectoral end 82, which is received in the insertion hole 56 of the seat body 51 such that the sectoral end 82 is put through the cross through hole 54 of the stop wall 55 of the seat body 51 via the cross tube 65 of the position confining member 62 and the cross axial hole 60 of the one-way roller 58.

The position controlling sleeve 83 is engaged with another end of the threaded rod 81 and is similar in diameter to the receiving slot 52 of the seat body 51. The position controlling sleeve 83 is provided in the outer wall thereof with a retaining hook 84, which is retained by one of the retaining holes 57.

The locating tube 59 of the one-way roller 58 is fastened with the threaded rod 81 by a pin 85. The retaining piece 73 is received in an outer threaded slot 86 of the threaded rod 81 so as to actuate the roller 58 and the threaded rod 81. As a result, the position confining member 62 is caused to displace horizontally in a reciprocating manner in the receiving slot 52 of the seat body 51.

As shown in FIG. 3, the skidproof structure 40 is composed of a locating shell seat 41 which is fastened with the undersides of the front side 301 and the two lateral sides 302 of the base 30 and is provided in the underside thereof with a plurality of locating holes 42 for locating a plurality of the skidproof blocks 43.

The cross tube 65 of the position confining member 62 is provided respectively at both ends thereof with a toothed recess 651. The axial tube 591 of the one-way roller 58 is provided with a toothed projection 592. The position controlling sleeve 83 is provided with a toothed protuberance 831. The position confining member 62 is capable of a horizontal reciprocating motion in the receiving slot 52 such that the toothed recesses 651 of the cross tube 65 of the position confining member 62 are engaged with the toothed projection 592 of the one-way roller 58 and the toothed protuberance 831 of the position controlling sleeve 83.

Figure 5:
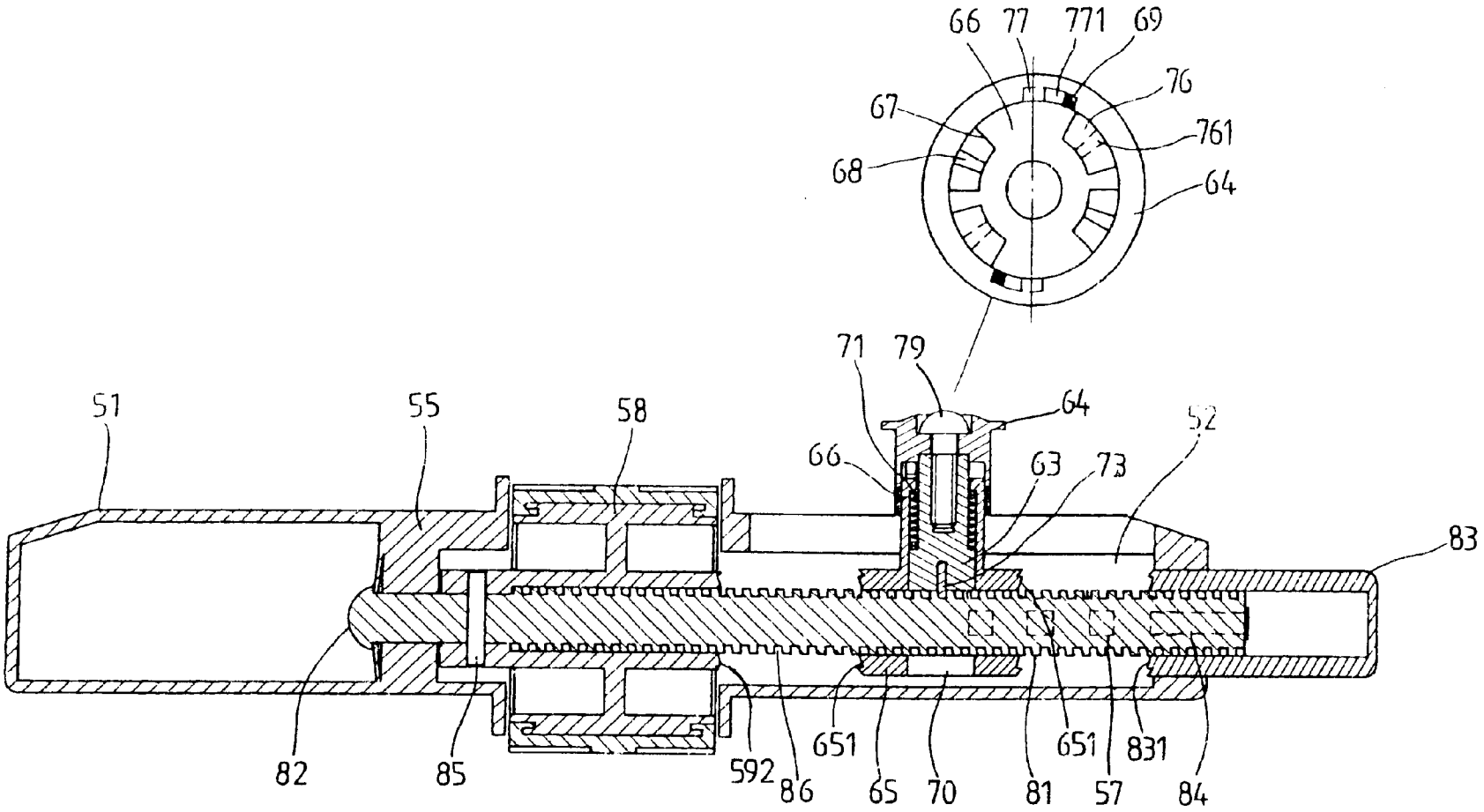
FIG. 5 shows a sectional view of the wheel seat assembly of the present invention in combination.
Figure 6:
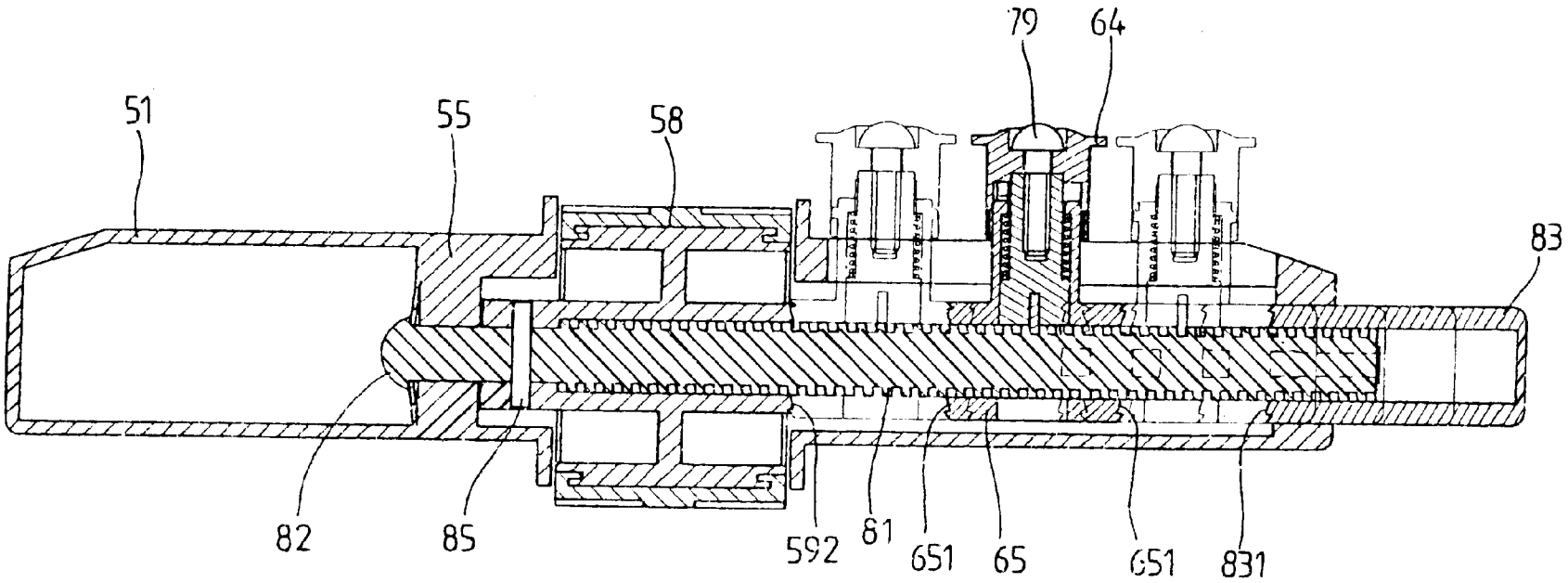
FIG. 6 shows a schematic view of the wheel seat assembly of the present invention in operation.
Figure 7:
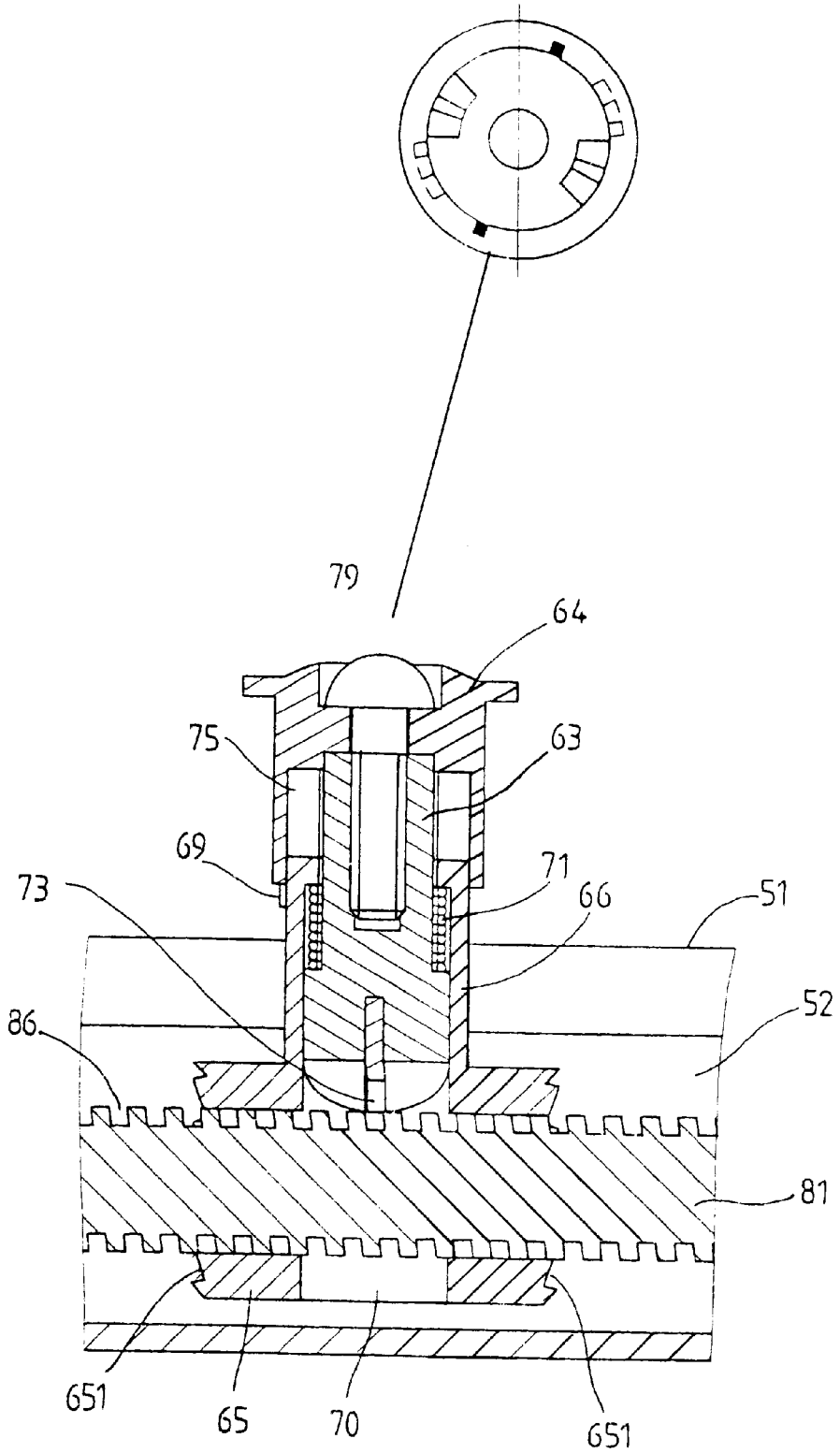
FIG. 7 shows another schematic view of the wheel seat assembly of the present invention in operation.

As illustrated in FIGS. 5 and 6, the moving range of the walker of the present invention can be so adjusted and confined to prevent an accident. In the process of adjusting to confine the moving range of the walker of the present invention, the position controlling sleeve 83 is first adjusted appropriately in such a way that the retaining hook 84 of the position controlling sleeve 83 is disengaged with the retaining hole 57 of the receiving slot 52, and that the position controlling sleeve 83 is adjusted in position to locate appropriately on the threaded rod 81, thereby enabling the position confining member 62 to engage in a horizontal reciprocating motion in the receiving slot 52. In other words, when the position controlling sleeve 83 in located in the direction toward the one-way roller 58, the moving space of the position confining member 62 becomes smaller. When the walker 20 of the present invention is actuated by a baby to move, the one-way roller 58 is thus actuated to turn. As a result, the threaded rod 81 is actuated to turn. In the meantime, the arcuate edge 72 of the retaining member 63 of the position confining member 62 is in contact with the threaded rod 81 such that the retaining piece 73 is extended into the outer threaded slot 86 of the threaded rod 81. The rotational motion of the threaded rod 81 is capable of actuating the position confining member 62 to engage in a horizontal displacement in the receiving slot 52. When the cross tube 65 of the position confining member 62 has moved to the end of the position controlling sleeve or the side of the one-way roller 58, the cross tube 65 is stopped to prevent the threaded rod 81 and the one-way roller 58 from turning in the same direction. In view of the fact that the one-way roller 58 is provided with a skidproof ring, the walker 20 is forced to move in reverse. The one-way roller 58 is thus caused to turn in another direction. The safe moving range of the walker 20 of the present invention is attained by the adjustment of the position controlling sleeve 83. On the other hand, the walker 20 of the present invention may be so adjusted as to allow the walker 20 to move about without limitation, as illustrated in FIG. 7. Such an adjustment is attained by pulling the position controlling button 64 of the straight tube 66 of the position confining member 62, so as to actuate the bolt 79 and the retaining member 63 to rise such that the end of the retaining member 63 and the retaining piece 73 become disengaged with the threaded rod 81. In the meantime, the position controlling button 64 is turned in one direction and then let go, thereby resulting in the engagement of the recessed edge 761 of the stop edge 76 with the small protuberance 68 of the protruded piece 67. As a result, when the threaded rod 81 is actuated by the one-way roller 58, the retaining member 63 of the position confining member 62 is not engaged with the threaded rod 81. For this reason, the threaded rod 81 in motion is not capable of actuating the position confining member 62 to engage in a horizontal reciprocating motion. The one-way roller 58 is thus capable of turning freely without limitation.

As shown in FIG. 3, the skidproof structure 40 is provided with a skidproof block 43 capable of stopping the walker 20 in motion when the wheels of the walker 20 in motion are caught in the potholes. This safety feature prevents the overturn of the walker 20.

The embodiment of the present invention described above is to be deemed in all respects as being merely illustrative and not restrictive. Accordingly, the present invention may be embodied in other specific forms without deviating from the spirit thereof. The present invention is therefore to be limited only by the scope of the following appended claims.

I claim:

1. A walker for a baby, the walker comprising a base, a wheel set, and a plurality of skidproof structures fastened with the undersides of a front side and two lateral sides of said base such that the reference surfaces of bottoms of said skidproof structures are slightly higher than said wheel set fastened with said base, said wheel set comprising a universal wheel fastened with the underside of said front side of said base, and a one-way wheel seat assembly fastened with the underside of a rear side of said base, said wheel seat assembly comprising:

a seat body fastened with said underside of said rear side of said base by a plurality of fastening bolts and provided at a top thereof with a receiving slot, said seat body further provided in a center thereof with a wheel hole extending through an underside of said seat body, a stop wall contiguous to said wheel hole and having a cross through hole, an insertion hole opposite in location to said cross through hole, and a plurality of retaining holes located between said wheel hole and said insertion hole, a one-way roller being located in said wheel hole such that a locating tube of said one-way roller is in contact with said stop wall, and that a cross axial hole of said one-way roller is in communication with said cross through hole of said stop wall;

a locating member composed of a position confining member, a retaining member, and a position controlling button, said position confining member being of a hollow construction and provided with a cross tube having a straight tube extending therefrom, said straight tube provided with two protruded pieces opposite in location to each other, a small protuberance, and two protruded edges which are arranged with said two protruded pieces in a cruciform manner, said position confining member provided at one end thereof with a spring fitted thereover and at another end thereof with an arcuate edge engaged with a retaining piece, said position controlling button provided with a hole having in an inner wall thereof two stop edges opposite in location to each other, said cross tube of said position confining member being located in said receiving slot of said seat body, said position controlling button being fastened with one end of said retaining member by a fastening bolt such that said retaining member can be actuated by said position controlling button to displace in the direction toward said straight tube, and that said retaining member can be forced to return to an original position thereof by an elastic force of said spring, said cross tube of said position confining member provided at both ends thereof with two through holes opposite in location to said cross axial hole of said one-way roller and said insertion hole of said seat body;

a threaded rod having a sectoral end which is engaged with said insertion hole such that said stop wall is urged by said sectoral end via said cross tube of said position confining member, said cross axial hole of said one-way roller and said cross through hole of said seat body; and a position controlling sleeve fitted over another end of said threaded rod and provided in an outer wall thereof with a retaining hook engageable with any one of said retaining holes of said seat body.

2. The walker as defined in claim 1, wherein said skidproof structures are fastened respectively with said undersides of said front side and said two lateral sides of said base, said skidproof structures having a locating shell seat which is provided in an underside thereof with a plurality of locating holes for fastening a skidproof block.

3. The walker as defined in claim 1, wherein said cross tube of said position confining member is provided respectively at both ends thereof with a toothed recess; wherein said one-way roller is provided with a toothed projection corresponding in location to and engageable with said toothed recess of said cross tube of said position confining member; wherein said position controlling sleeve is provided with a toothed protuberance; and wherein said position controlling member is received in said receiving slot of said seat body such that said position controlling member is capable of a reciprocating motion in said receiving slot, and that said two toothed recesses of said position confining member are engageable with said toothed projection of said one-way roller and said toothed protuberance of said position controlling sleeve.

* * * * *